US011079116B2

(12) United States Patent
Siburt

(10) Patent No.: US 11,079,116 B2
(45) Date of Patent: Aug. 3, 2021

(54) APPARATUS AND METHOD FOR CONTROLLING ELECTRIC BURNER ELEMENT INPUT

(71) Applicant: Peerless-Premier Appliance Co., Belleville, IL (US)

(72) Inventor: Gary A Siburt, Waterloo, IL (US)

( * ) Notice: Subject to any disclaimer, the term of this patent is extended or adjusted under 35 U.S.C. 154(b) by 268 days.

(21) Appl. No.: 16/054,730

(22) Filed: Aug. 3, 2018

(65) Prior Publication Data

US 2019/0041064 A1 Feb. 7, 2019

Related U.S. Application Data

(60) Provisional application No. 62/541,480, filed on Aug. 4, 2017.

(51) Int. Cl.

| | |
|---|---|
| ***H05B 1/02*** | (2006.01) |
| ***F24C 7/08*** | (2006.01) |
| ***G05G 1/08*** | (2006.01) |
| ***H01H 71/16*** | (2006.01) |
| ***H01H 19/03*** | (2006.01) |
| ***G05G 1/10*** | (2006.01) |
| ***G05G 5/04*** | (2006.01) |
| ***H01H 89/04*** | (2006.01) |
| ***H01H 19/62*** | (2006.01) |
| *H01H 37/12* | (2006.01) |
| *H01H 71/74* | (2006.01) |

(52) U.S. Cl.

CPC ..... *F24C 7/082* (2013.01); *G05G 1/082* (2013.01); *G05G 1/10* (2013.01); *G05G 5/04* (2013.01); *H01H 19/03* (2013.01); *H01H 19/62* (2013.01); *H01H 71/16* (2013.01); *H01H 89/04* (2013.01); *H01H 37/12* (2013.01); *H01H 71/7436* (2013.01)

(58) Field of Classification Search

CPC . G05G 1/082; G05G 1/10; G05G 1/04; F24C 7/082; H01H 19/03; H01H 19/62; H01H 17/06; H01H 89/04; H01H 37/12; H01H 71/7436; H05B 1/02; H05B 1/0263; H05B 1/0261; H05B 3/0076

USPC ..... 219/494, 497, 507–510, 490, 491

See application file for complete search history.

(56) References Cited

U.S. PATENT DOCUMENTS

| | | | | |
|---|---|---|---|---|
| 3,891,957 A * | 6/1975 | Holtkamp | H01H 35/2635 | 337/347 |
| 4,111,358 A * | 9/1978 | Semple | F24C 7/08 | 219/398 |
| 4,214,224 A * | 7/1980 | Holtkamp | F24C 14/02 | 337/115 |
| 6,057,529 A * | 5/2000 | Kirby | H05B 3/746 | 219/445.1 |
| 6,246,033 B1 | 6/2001 | Shah | | |

(Continued)

*Primary Examiner* — Mark H Paschall

(74) *Attorney, Agent, or Firm* — Greensfelder, Hemker & Gale, P.C.; Mark E. Stallion

(57) ABSTRACT

An apparatus and method for restricting the rotation of a dial control knob on the high setting of an electric cooking range using one of three methods. The first method adds a detent stop internally to the switch. The second method adds a detent stop externally attaching to the control panel behind the top burner knob. Both of the aforementioned methods are designed to prevent rotation of the control knob to a maximum of 227° rotation. A third limits the on/off cycling of the top element switch while in operation to reduce the overall output of the switch.

6 Claims, 13 Drawing Sheets

#3 Knob at 227° rotation

(56) References Cited

U.S. PATENT DOCUMENTS

| | | | | |
|---|---|---|---|---|
| 6,700,100 | B2 | 3/2004 | Lerner | |
| 2003/0015518 | A1 | 1/2003 | Baker et al. | |
| 2003/0116557 | A1* | 6/2003 | Graff | F24C 7/087 219/492 |
| 2005/0109333 | A1 | 5/2005 | Thomas | |
| 2010/0163549 | A1 | 7/2010 | Gagas et al. | |
| 2011/0095017 | A1* | 4/2011 | Steurer | H02J 3/14 219/493 |
| 2011/0290781 | A1 | 12/2011 | Burt et al. | |

* cited by examiner

#2 Mechanical stop detent

#1 "OFF" Position

#3 Knob at 227° rotation

STEM FLAT 12:00
GRAPHICS: HELVITICA BOLD TO BE 12 PT.
900
506
700
702
704
706
802
KNOB STOP PLATE PIN
15.13 SHAFT STOP
1.0 X 1.5 HASH MARK TYP. (7) PLCS.
3.0 X 1.0 HASH MARK TYP. (6) PLCS.
HASH MARK CENTERED BETWEEN NUMERALS

APPARATUS AND METHOD FOR CONTROLLING ELECTRIC BURNER ELEMENT INPUT

CROSS REFERENCE

This application claims the benefit of and priority to U.S. Provisional Patent Application Ser. No. 62/541,480 entitled APPARATUS AND METHOD FOR CONTROLLING ELECTRIC BURNER ELEMENT INPUT filed Aug. 4, 2017, and is hereby incorporated herein by reference in its entirety.

BACKGROUND

Field

This technology as disclosed herein relates generally to electrical ranges and, more particularly, to controlling electrical current input to a top burner element.

Background

Top burner cooking is recognized as "attended cooking", thereby someone is present while using the top burner section of the cooking range. Rotary switches can be provided to control the current applied to the top burner elements and thereby control the cooking temperature of the top burner elements. A control knob can be mounted on a shaft of the rotary switch, which is thereby utilized to rotate the shaft to control the level of the rotary switch. The rotary switch used for temperature control may include a potentiometer that is operated by rotating the shaft to provide a continuously variable control signal that corresponds to the current being provided to the top burner element and therefor the temperature range. Temperature level identifiers can be indicia, such as tic marks or an alphanumeric, printed along the peripheral circumference of the control knob or as indicia on the control panel from which the shaft of the rotary switch extends. Regulations regarding the temperature level controls has recently changed, which will require certain safeguards to prevent the top burner element from overheating. The proposed change provides a safeguard in the event an attendant using the cooking range leaves the range or inadvertently forgets and leaves the top burner in the "ON" position. Traditional top burner coils, without governing controls, will overheat to a point of flashover once the cooking pan or its contents reaches or exceeds 605° F.

It has been determined that when cooking with oil and the temperatures reach above 605° F., the cooking oil vaporizes and the flashover can occur. The UL858 Article 60A test procedure requires a 10" aluminum unfinished pan with ⅛" deep of canola oil heated at maximum temperature setting on the dial for 30 minutes without flashing over and igniting in flames. The flash point of canola oil is 619° F. Controlling the top burner temperature to maintain food contents below the flashover point, and at the same time provide a satisfactory cooking experience is a goal of adding the safety devices.

Overheating cooking oil allows it to go from liquid to vapor. Once cooking oil turns to vapors the ability for it to combust and flashover becomes significantly higher. The standard being implemented by Underwriters Laboratories lessens the possibility of "unattended cooking" to overheat food products or cooking oils resulting in kitchen fires. One method for determining compliance is a dry pan test method. A flat bottomed 10" cast-iron pan with 5 temperature sensors imbedded in the surface is placed on the largest element located on the front section of the top. The range is turned on and the temperature is monitored for 30 minutes on the high setting. The temperature of the pan cannot exceed 725° F. With the changes in UL858 cooking standards, the need to prevent flashover fires of cooking oil on exposed electric coil elements becomes effective in June 2018. In order to prevent this exposure from occurring, a method for monitoring or switching the heating coil to prevent over heating of cooking oil is needed.

SUMMARY

The technology as disclosed herein includes an apparatus and method to limit heating of top burner elements on coil electric cooking ranges by controlling the input of electric currents to the top burner elements.

The process by which temperature is controlled is by limiting the amount of current that passes to the heating element. The method used allows satisfactory heat up of the coil element, but limiting the amount of current at the maximum setting to prevent the element from exceeding 605° F. This is accomplished by restricting the rotation of the dial knob on the high setting using one of three methods. The first method adds a detent stop internally to the switch where the detent within the switch limits the rotation of the shaft and thereby limits the temperature level. The second method adds a detent stop externally by attaching a detent plate to the control panel behind the top burner knob and where the control knob has a member that engages with the detent plate to stop rotation of the control knob. Both of the aforementioned methods are designed to prevent rotation of the control knob to a maximum of 227° rotation. A third method is the process by which the temperature limit is controlled through the top element switch. By modifying the switch it is possible to limit the cycling of the switch (On vs Off) to maintain a maximum temperature limit below the flashpoint of oil while maintaining the ability to use the appliance for cooking.

Several methods have been on the marketplace for some time. Many of the current methods being proposed or currently being used employ a temperature sensing device positioned somewhere near the top burner element to monitor temperatures of surfaces at or near the cooking position. This method appears to be effective providing the proper location and size, and the contents of the cooking pan remain consistent. Changes in these parameters change the outcome of the cooking. Testing many of the proposed temperatures sensing devices found that once maximum temperature of the sensing device is reached, the cooking element then cycles on and off using the sensing devices and no longer uses the control knob designed to regulate temperature selection. Whereas, the method and apparatus as disclosed and claimed herein limits the full rotation of the control knob and uses the individual burner control to maintain and govern maximum allowable current to prevent an overheat condition and possible flashover.

The purpose of the technology is to provide safe cooking experience on electric coil ranges by controlling the upper threshold in which a coil element may reach in temperature, thus reducing the probability of flash over fires. The method meets the UL858 standard Article 60A Effective Date Jun. 15, 2018.

One implementation of the technology as disclosed and claimed herein includes a current limiting device for an electric cooking range including a mechanical stop detent member extending from a mounting bracket where the mounting bracket has a central through hole. This implementation further includes a rotary switch having a shaft mounted to control the rotational position of the rotary switch and said shaft extends from said rotary switch and through the central through hole of the mounting bracket. In addition, this implementation includes a control knob having a rear cavity and a shaft collar extending from the rear cavity and mounted on said shaft and further having a knob stop plate pin extending from the cavity and said stop plate pin positioned to engage the mechanical stop detent when the control knob rotates the shaft and rotary switch to its maximum setting.

Another implementation of the technology as disclosed and claimed is a current limiting device for an electric cooking range including a rotary switch having a shaft mounted to control the rotational position of the rotary switch and said shaft extends from said rotary switch. This implementation further includes a detent mounted on the rotary switch and position to engage and stop rotation of the shaft and the rotary switch at its maximum setting. This implementation further includes a control knob having a rear cavity and a shaft collar extending from the rear cavity and mounted on said shaft.

Another implementation of the technology includes a method to current limit an electric cooking range including rotating a control knob having a rear cavity and a shaft collar extending from the rear cavity and mounted on a shaft extending from a rotary switch and where said control knob further having a knob stop plate pin extending from the cavity and said stop plate pin is positioned to engage a mechanical stop detent when the control knob rotates the shaft and the rotary switch to its maximum setting. This implementation further includes rotating the shaft mounted to the rotary switch with the control knob thereby controlling the rotational position of the rotary switch. The method also includes controlling a current applied to a top burner element of an electric cooking range by rotating the control knob to thereby rotate the stop plate pin to engage a mechanical stop detent.

Another implementation of the method includes a method to current limit an electric cooking range including rotating a control knob having a rear cavity and a shaft collar extending from the rear cavity and mounted on a shaft extending from a rotary switch. This implementation of the method further includes rotating the shaft mounted to the rotary switch with the control knob thereby controlling the rotational position of the rotary switch. This method further includes controlling a current applied to a top burner element of an electric cooking range by rotating the control knob to thereby rotate the shaft to engage a mechanical stop detent of the rotary switch when the rotary switch is at its maximum setting.

The features, functions, and advantages that have been discussed can be achieved independently in various implementations or may be combined in yet other implementations further details of which can be seen with reference to the following description and drawings.

These and other advantageous features of the present technology as disclosed will be in part apparent and in part pointed out herein below.

BRIEF DESCRIPTION OF THE DRAWINGS

For a better understanding of the present technology as disclosed, reference may be made to the accompanying drawings in which.

Figure 2:
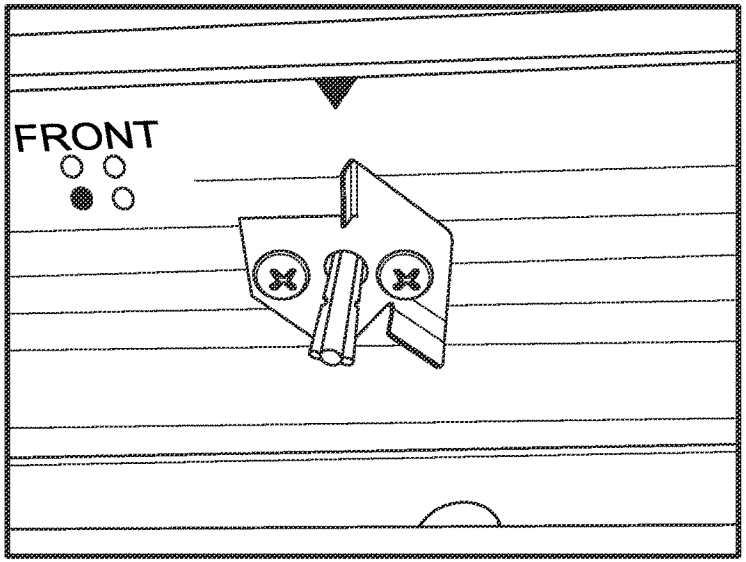
FIG. 2 is an illustration of a mechanical stop detent.

While the technology as disclosed is susceptible to various modifications and alternative forms, specific implementations thereof are shown by way of example in the drawings and will herein be described in detail. It should be understood, however, that the drawings and detailed description presented herein are not intended to limit the disclosure to the particular implementations as disclosed, but on the contrary, the intention is to cover all modifications, equivalents, and alternatives falling within the scope of the present technology as disclosed and as defined by the appended claims.

DESCRIPTION

According to the implementation(s) of the present technology as disclosed, various views are illustrated in FIG. 1-15 and like reference numerals are being used consistently throughout to refer to like and corresponding parts of the technology for all of the various views and figures of the drawing. Also, please note that the first digit(s) of the reference number for a given item or part of the technology should correspond to the Fig. number in which the item or part is first identified.

One implementation of the present technology as disclosed comprising a mechanical detent teaches a novel apparatus and method for limiting current input to a top burner element of an electric cooking range.

Figure 1:
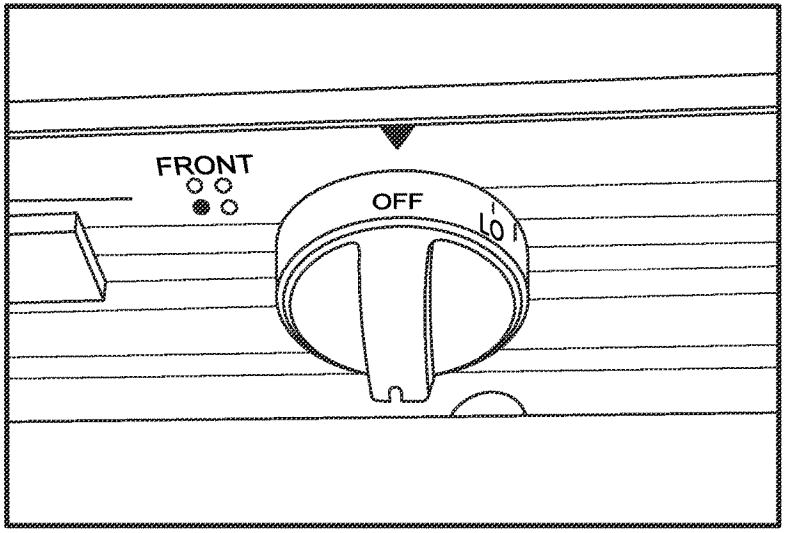
FIG. 1 is an illustration of a control knob rotated to the off position.

The details of the technology as disclosed and various implementations can be better understood by referring to the figures of the drawing. Referring to FIG. 1, an illustration of a control knob rotated to the off position is provided. A stop detent, not shown in this illustration, can be provided as a stop for both the OFF and HI ends of the rotational range.

Referring to FIG. 2, an illustration of a mechanical stop detent is provided that is mounted to the control panel of an electric cooking range. The arrow on the control panel above the control knob is positioned to align with the indicia (OFF, LO, HI and numbers and tic marks) along the periphery of the control knob indicative of the current level setting of the rotational switch, thereby indicative of the level of current being provided to the top burner elements and the cooking temperature of the elements.

Figure 3:
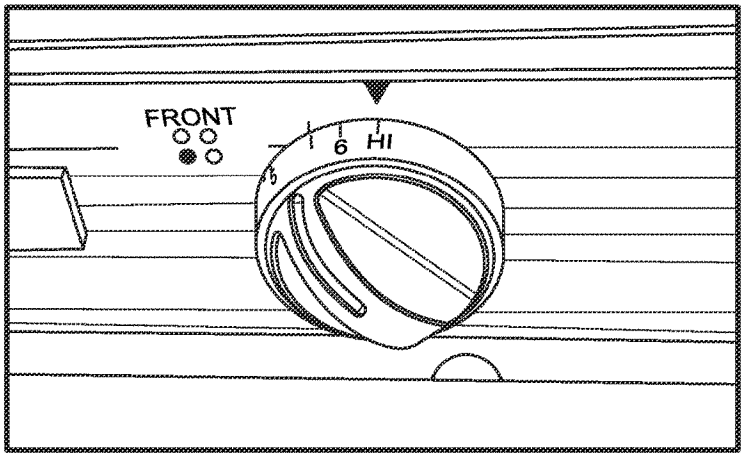
FIG. 3 is an illustration of a control knob set to High and rotated approximately 227 degrees from the Off position.

Referring to FIG. 3, an illustration of a control knob set to High and rotated approximately 227 degrees from the Off position is provided. A stop detent, not shown in this illustration, can be provided as a stop for both the OFF and HI ends of the rotational range. The arrow on the control panel above the control knob is aligned with the HI indicia along the periphery of the control knob indicative of the current level setting of the rotational switch set to HI, thereby indicative of the highest level of current being provided to the top burner elements and the cooking temperature is at its highest setting for the elements.

Figure 4:
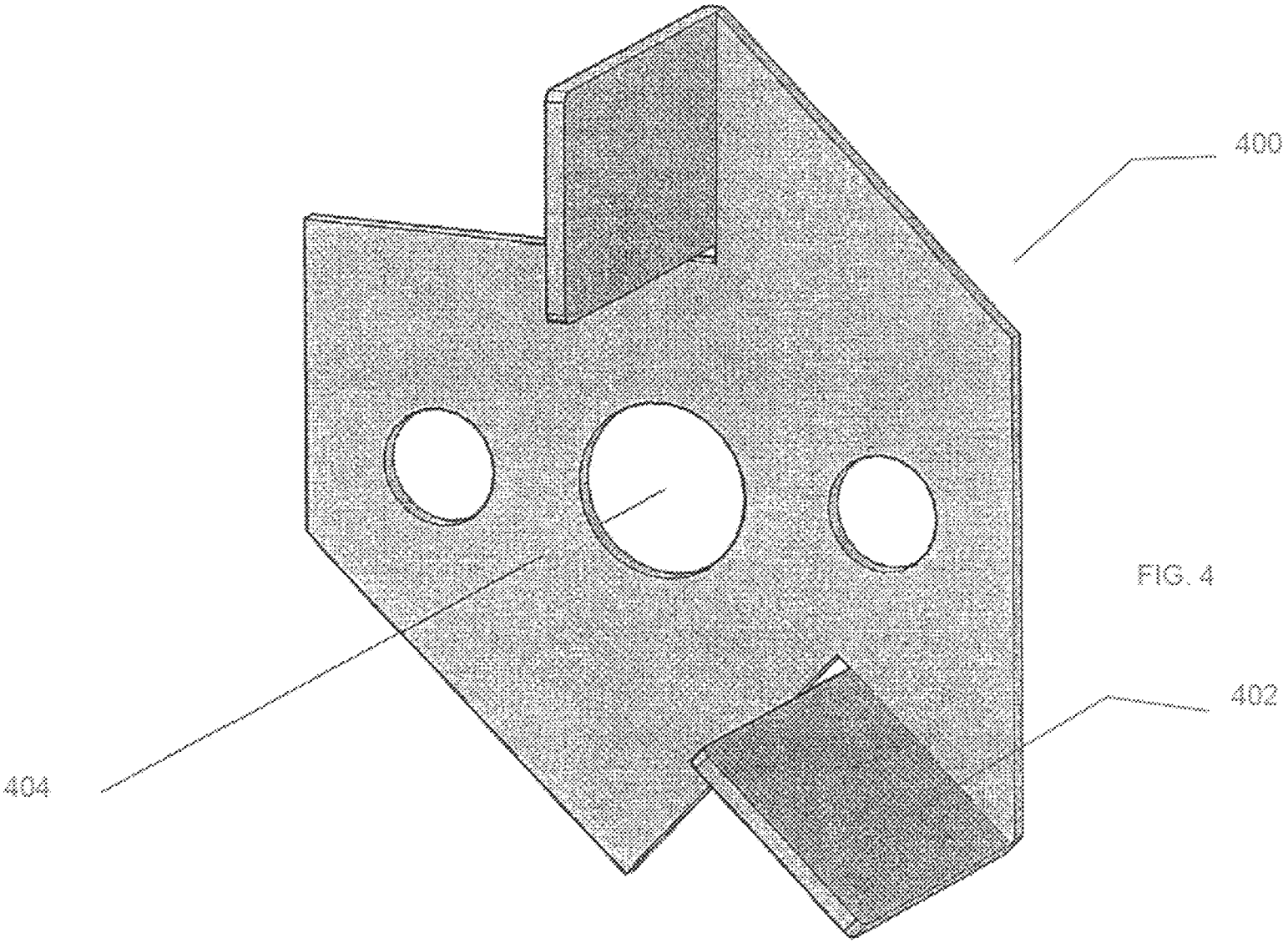
FIG. 4 is a perspective view of a mechanical stop detent.

Referring to FIG. 4, a perspective view of a mechanical stop detent 400 is provided. The stop detent 402 is positioned to engage the knob stop plate pin when the rotational switch is rotated to a highest level. The mechanical stop detent 400 also has a central through hole 404 through which a rotational shaft from a rotational switch can extend.

Figure 5:
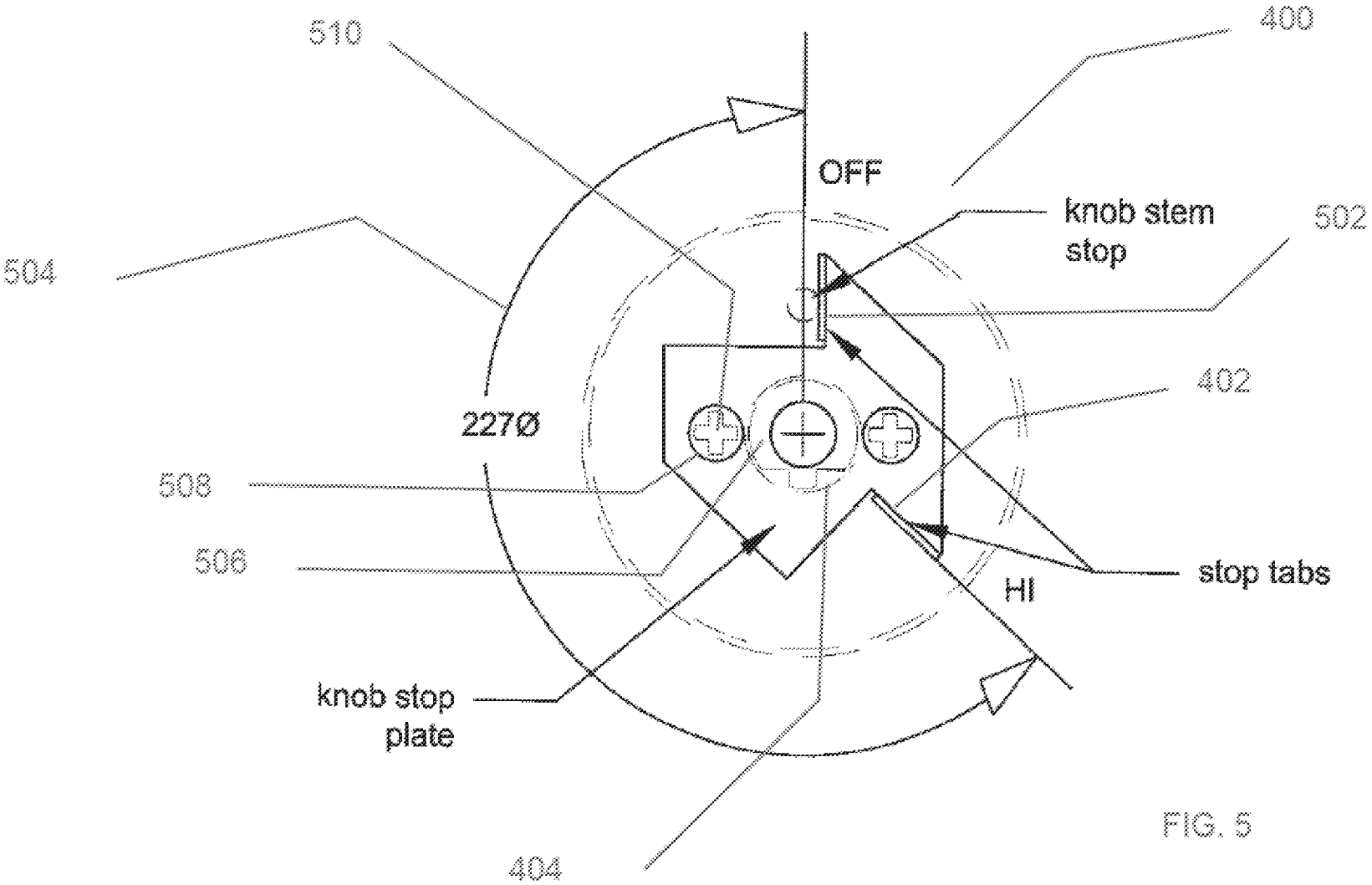
FIG. 5 is a top plan view of a mechanical stop detent.
Figure 6:
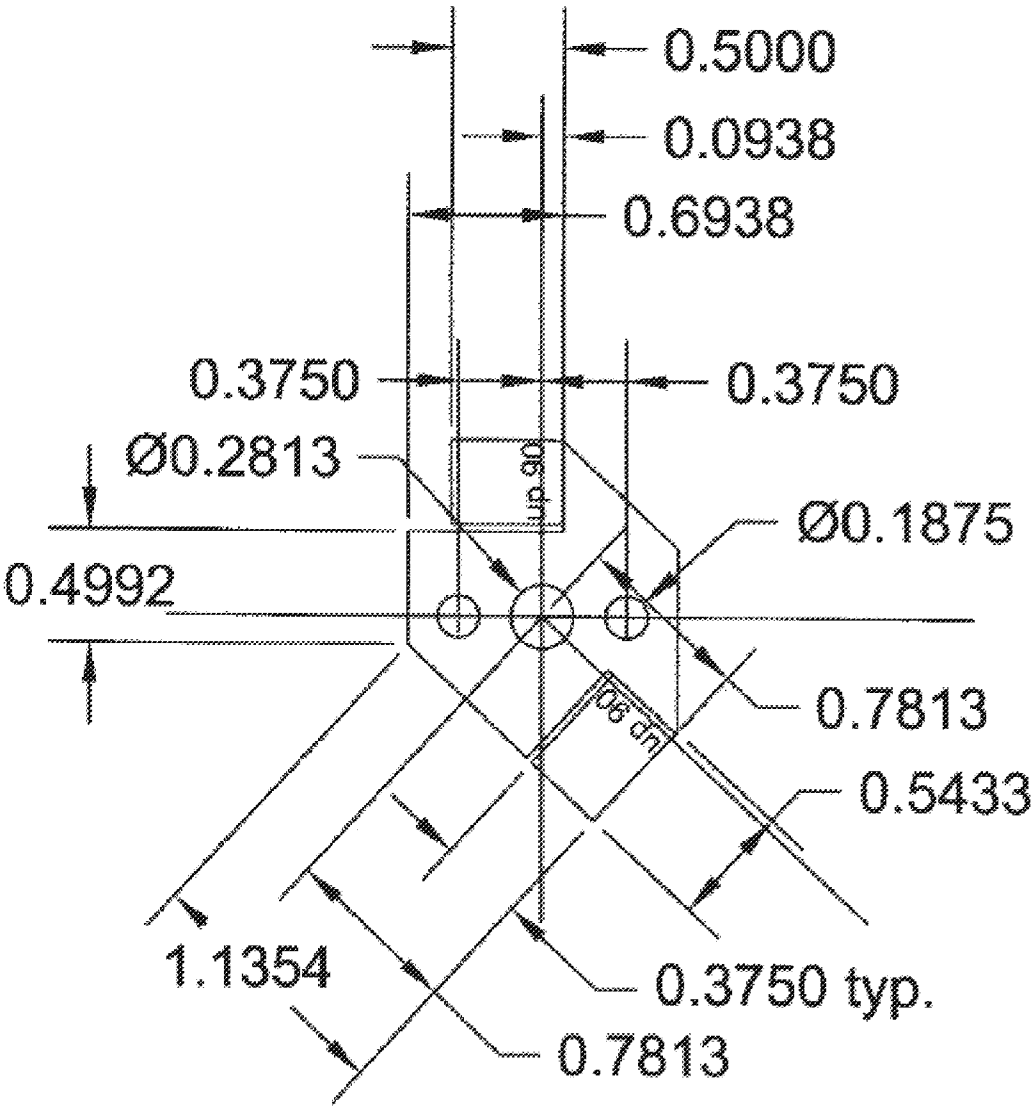
FIG. 6 is an illustration of a dimensional implementation of a mechanical stop detent.

Referring to FIG. 5, an illustration of a top plan view of a mechanical stop detent 400 is provided. The OFF detent 502 and the HI detent 402 are shown. The range of rotation 504, is illustrated as approximately 227 degrees of rotation. The mechanical stop detent 400 has a mounting through hole 508 for mounting the mechanical stop detent 400 to a control panel of an electric range with a fastener 510. The mechanical stop detent 400 is shown with a central through hole 404. An end of a shaft 506 is shown extending through the through hole 404 of the mechanical stop detent 400. FIG. 6 is an illustration of a dimensional implementation of a mechanical stop detent illustrating representative dimensions, however, these dimensions are only representative of one set of dimensions, but is in no way intended to narrow the scope of the technology as claimed to these specific dimensions.

Figure 7:
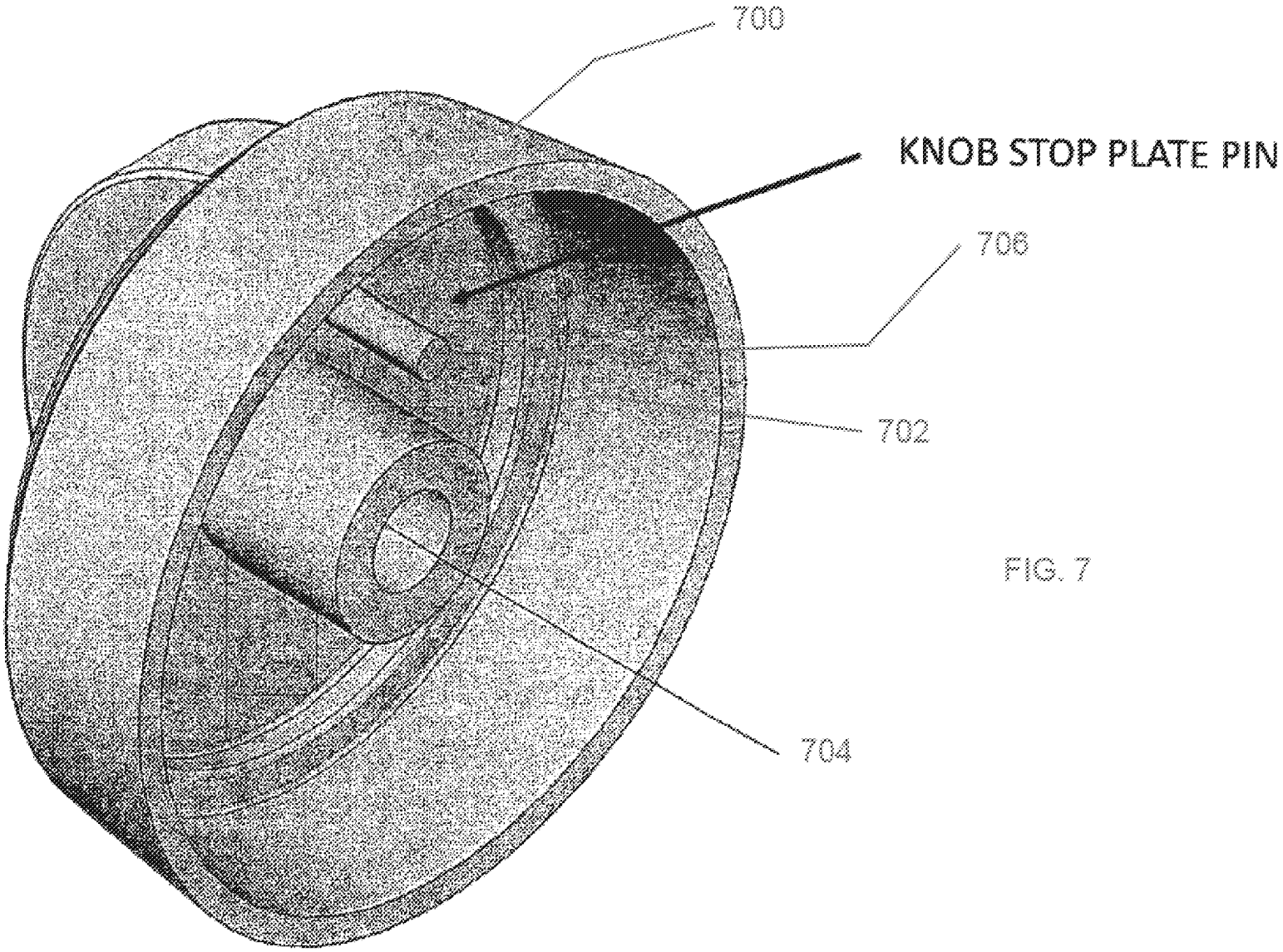
FIG. 7 is a perspective view of a control knob.

Referring to FIG. 7, a perspective view of a control knob 700 is illustrated. One implementation of the control knob 700 is illustrated having a backward facing cavity whose opening would face the control panel when the knob is installed. The control knob 700 includes a knob stop plate pin 706 extending in the cavity and an elongated shaft collar 702 extending in the cavity where the collar 702 has a central channel 704 for receiving a shaft of a rotational switch.

Figures 8A, 8B, 8C, 8D:
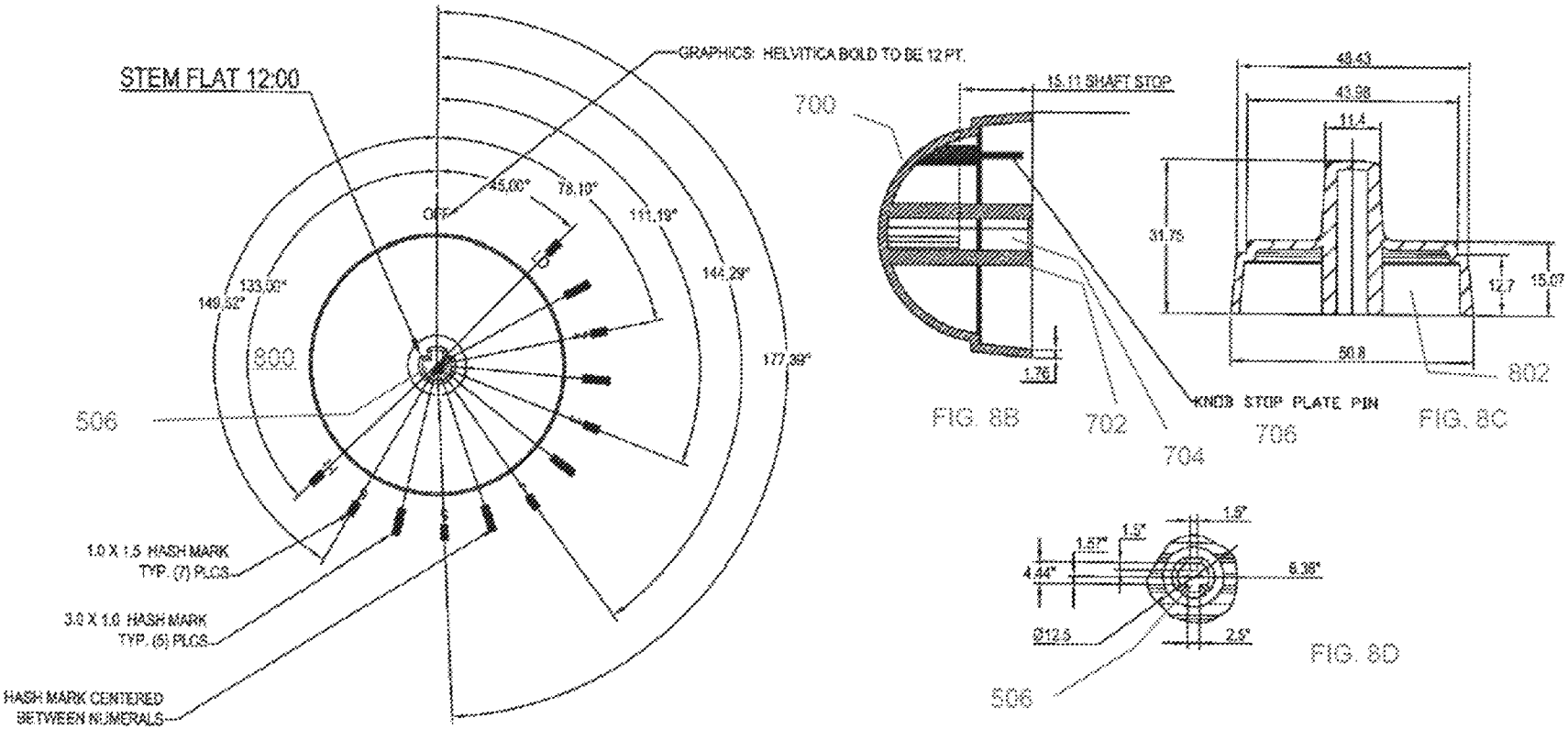
FIG. 8A is a plan elevation view of the control panel and a shaft.
FIG. 8B is a sectional view of a control knob.
FIG. 8C is a sectional view of the control knob.
FIG. 8D is an end view of a shaft.

FIG. 8A is a plan elevation view of the control panel and a shaft extending from the rotary switch. The various levels of rotation are illustrated by an alphanumeric such as OFF, LO and HI as well as graduated tic marks indicative of the level of rotation and hence the level of current flow and level of temperature. FIG. 8D is an end view of a shaft.

FIG. 8B is a sectional view of a control knob 700, which also illustrates the elongated collar 702 having a central channel 704 for receiving the shaft 506. The control knob stop plate pin is designed to engage the detent. FIG. 8C is a sectional view of the control knob.

Figure 9:
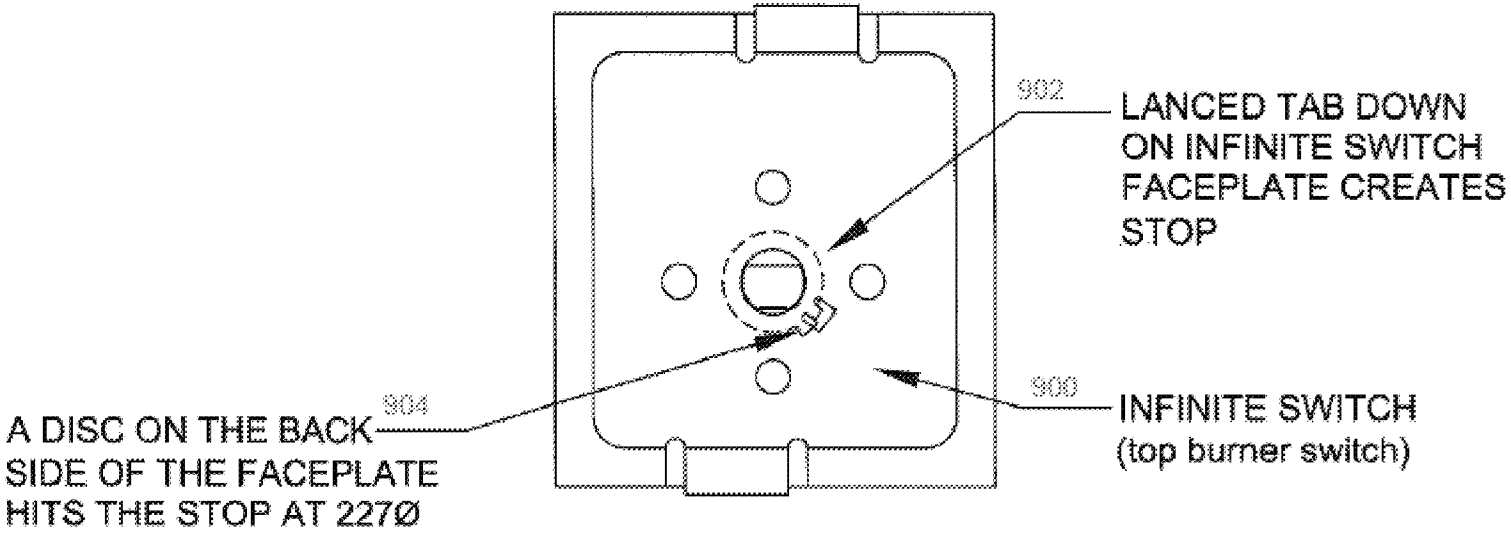
FIG. 9 illustrates an infinite rotary switch with a built in detent stop.

Referring to FIG. 9, an infinite rotary switch 900 with a built in detent stop is illustrated. For one implementation, the infinite rotary switch includes a lanced tab down 902 on the infinite switch face plate that creates a detent stop in order to stop rotation of the shaft (stem) of the rotary switch. For one implementation, the shaft (stem) can include a disc on the back side of the face plate of the infinite switch that engages the detent stop at 227 degrees from the OFF position.

Figures 10A, 10B:
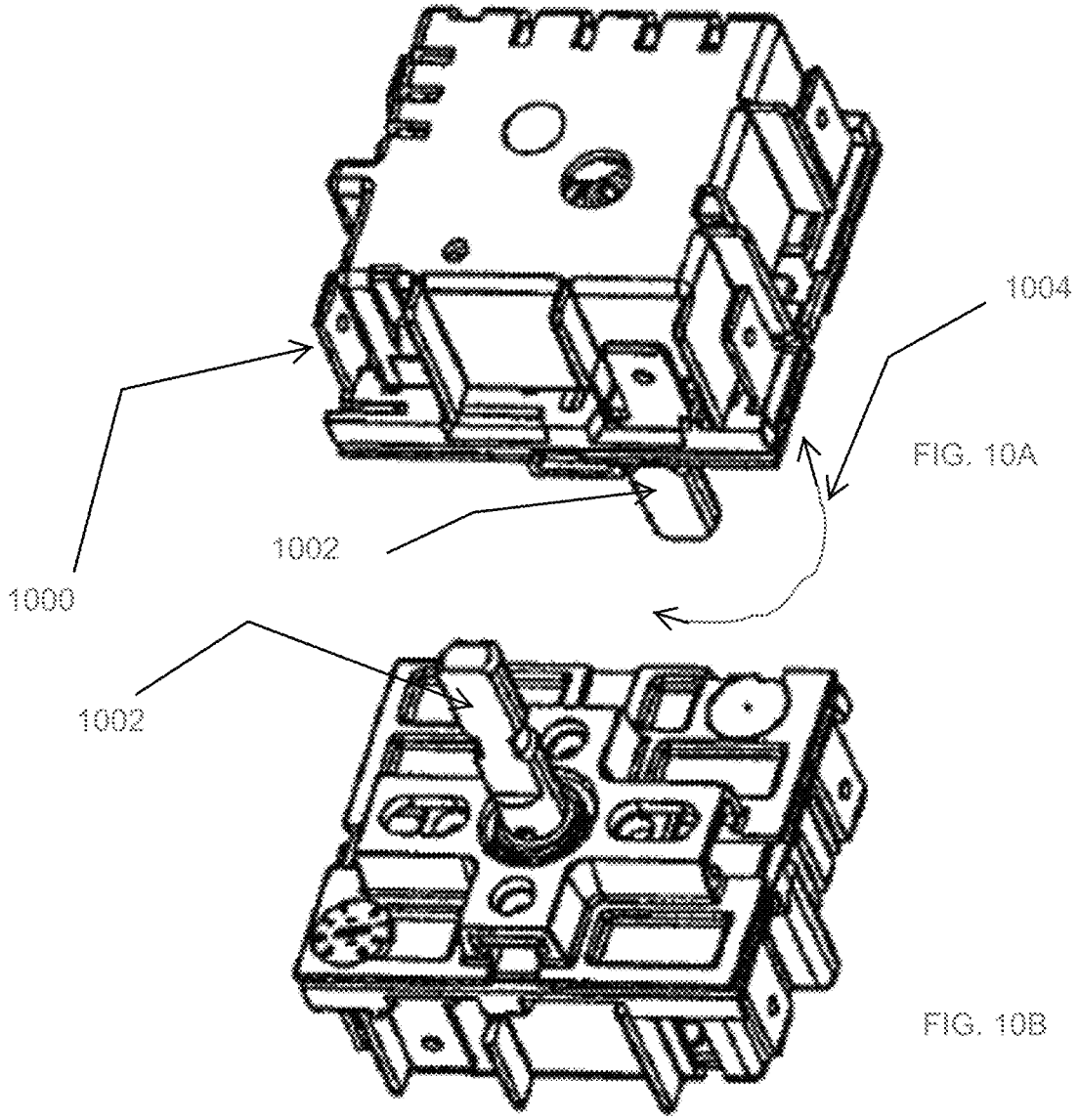
FIGS. 10A and 10B are isometric views of a switch assembly.
Figure 11:
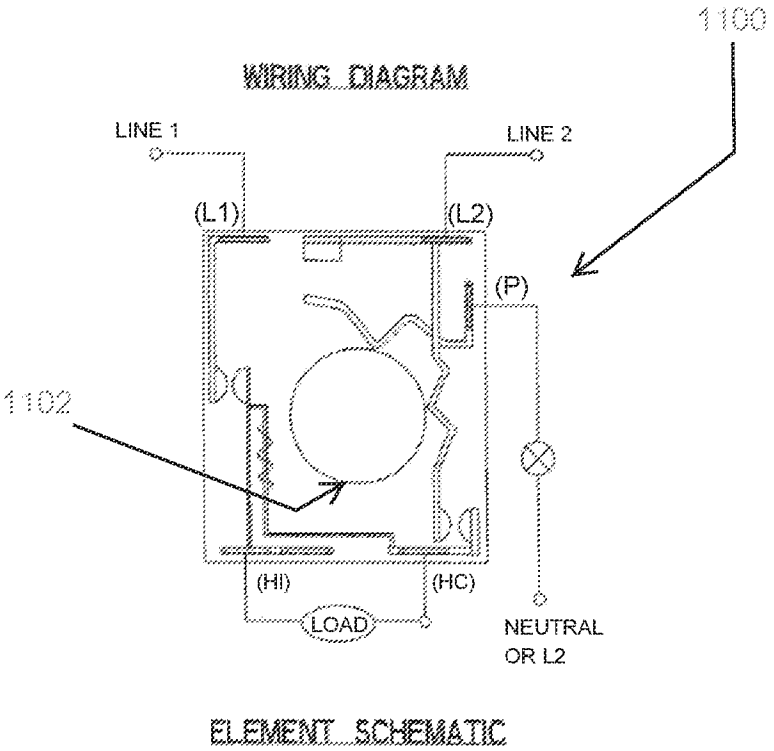
FIG. 11 is a an illustration of a wiring diagram and element schematic.
Figure 10C:
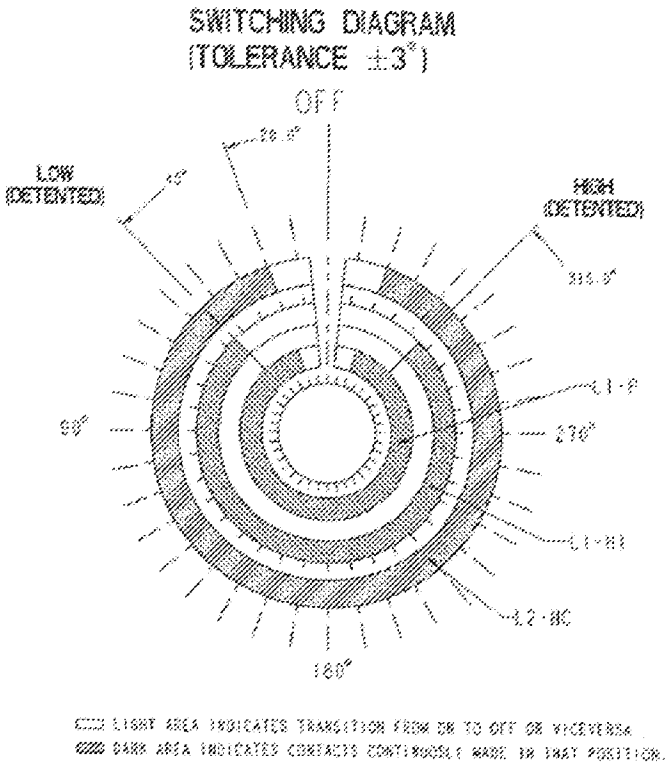
FIG. 10C is an illustration of a switching diagram.
Figure 12:
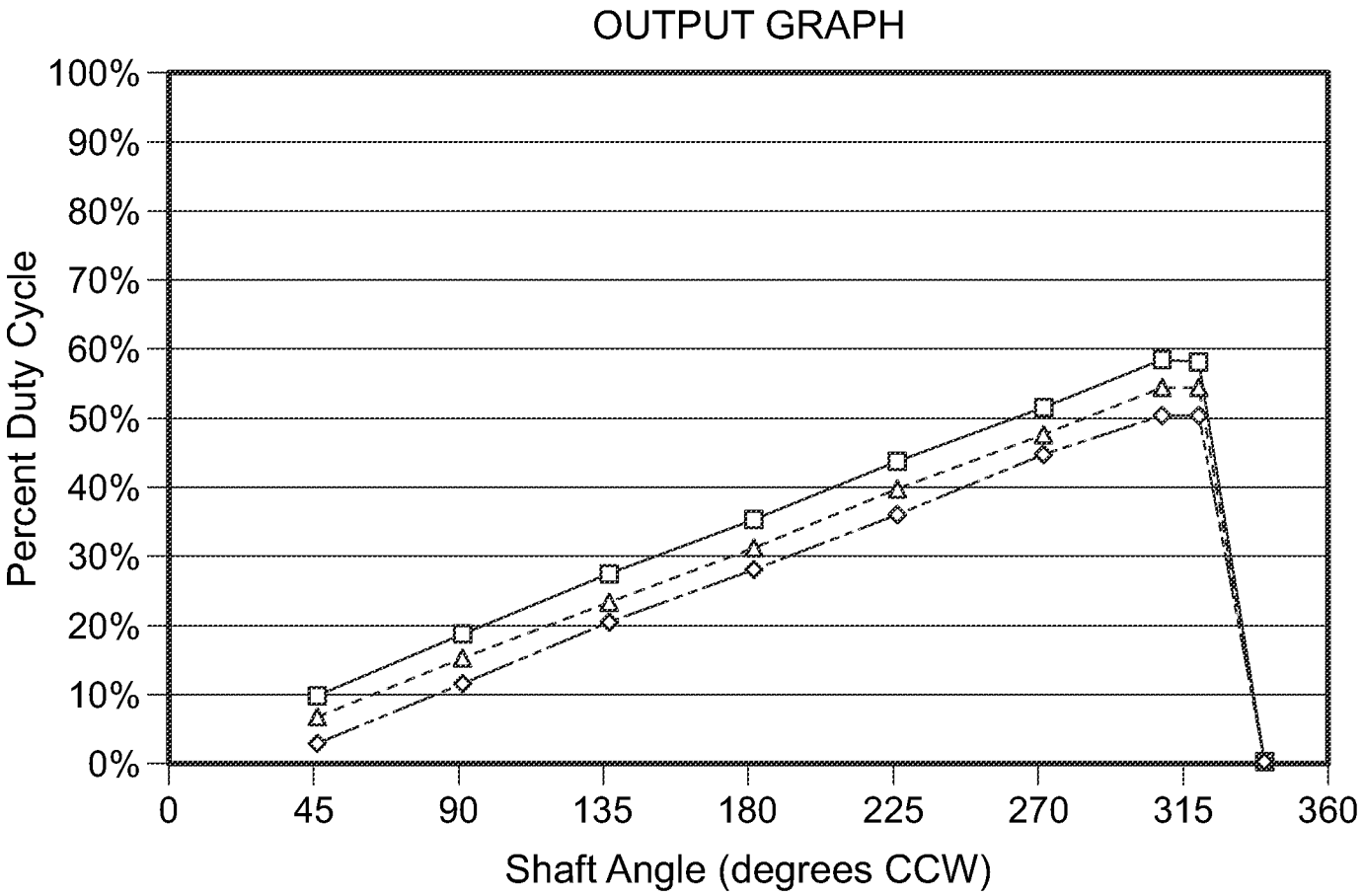
FIG. 12 is an illustration of an output graph.

FIGS. 10 through 12 provide an illustration of the third method and apparatus to provide a limiting switch. Referring to FIGS. 10A and 10B, isometric illustrations of a continuous switch assembly 1000 is provided illustrating a rotational switch stem 1002 that can be rotated in clockwise and counter clockwise rotational directions as illustrated by the directional arrows 1004. FIG. 10C provides a switching diagram where the light area indicates a transition from on to off or vice versa. The darkened area indicates continuous contact being made while the switch is in this area. FIG. 11 provides a wiring diagram and element schematic 1100. The cam 1102 in the continuous switch is utilized to increase or decrease pressure to control and limit the output. FIG. 11 is an illustration of an infinite switch. The switch operates in a manner where it cycles on and off at a frequency that depends on the current rotational position of the switch. Traditionally for many infinite switches utilized for this function when rotated to its full potential to the high setting, it may not cycle off at all. In many cases the switch stays on and the element is continuously powered and heats up and will continue to heat up as high as that element can get, which is unacceptable for regulatory standards. As the infinite switch is rotated down (counter clockwise) to lower settings, it cycles on and off with an increasing frequency as the switch is rotated further downward to lower settings. The frequency of how often the switch turns on and off, thereby controlling the on time and the off time will regulated the temperature of the element to the desired level. The present method and apparatus of the technology as disclosed and claimed herein is designed such that the maximum setting is at point to where the switch is on about 50% of the time and off about 50% of the time such that the method and apparatus as claimed reduces the output of the switch to the element to reduce the cycling of that on and off of the switch. With the method and apparatus the element can't overrun the temperature because it won't stay on long enough to overrun the temperature. It heats for a while then shuts off, it heats again and shuts off at a cycle where it is on approximately 50% of time and off 50% of the time, plus or minus 10%. By configuring the cam design, the technology as disclosed and claims controls and limits the length of time, that the limitless switch is on and the off time, to approximately 50% on, 50% off, plus or minus 50%.

The limitless switch includes a temperature sensing input that is indicative of the temperature of the element or the pan placed on the element and once the temperature sensed reaches a temperature level that is higher than desired based on the current setting, then the limitless switch is going to shut off its output to the element and the switch is not going to turn back on until the temperature of the element and thereby the pan drops to a certain point, and that's how the limitless switch design is preventing the pan from overheating. The present design utilizes the specially configured cam design to control and limit the switch. For one implementation of the technology the limitless switch is in-line with the element in the circuit of the element, and if the element or the pan gets too hot, it shuts the switch off. With the present technology as disclosed and claimed, it does not rely upon the temperature being sensed of the element or the pan necessarily. The present technology as disclosed and claimed modifies the cam to control and limit the frequency of the limitless switch going on and off, and thereby it limits how hot element or the pan can get. The apparatus and method varies from the traditional methodology of using a limitless switch that is controlled and regulated by a temperature sensor.

The technology as disclosed and claim utilizes an optimal point where the duty cycle is at about approximate 50% on and 50% off time and the cam us uses such that when the control knob is rotated past a certain point the switch doesn't continue to increase past the desire duty cycle. The cycle of 50% on and 50% off can vary by plus or minus 10 percent, for example 58% on and 42% off. Through tests it is determined how hot the element and pan could get without exceeding the temperature, but still allows for sufficient cooking temperatures. The same function can be accomplished as the first two methods and apparatus which uses a physical detent but with the limitless switch and a specially configured cam instead of with stop plate or indents in the stop plate.

The cam 1102 as illustrate in FIG. 11 within the switch applies pressure within the switch on a heated a bi-metal and such that when the heated bi-metal gets enough current flowing through it, it heats up and the bi-metal becomes more flexible bends and breaks the contact thereby shutting off the switch. The cam configuration is designed to apply the desired varying pressure to shut off the switch or cycle the switch off at the desired point in order to achieve the 50% on and 50% off result. The cam configuration provide a varying pressure against the arm and holds that arm in so it takes more heating or more current flowing through it to pop it open and disrupt the contact. The cam is configured to apply the necessary pressure corresponding to a defined rotation point of the knob to shut of the limitless switch by disrupting contact. With a traditional switch, which had not been configured to the achieve the desired duty cycle, that cam would have allowed the limitless switch to stay on full time and then the frequency would have been much greater as you ramp down through the selected temperatures. The cam ramps up or down depending on the rotation of the switch.

On implementation of a current limiting device for an electric cooking range as disclosed and claimed herein includes a mechanical stop detent member 402 extending from a mounting bracket 400 where the mounting bracket has a central through hole 404. The device includes a rotary switch having a shaft mounted to control the rotational position of the rotary switch and said shaft extends from said rotary switch and through the central through hole of the mounting bracket as illustrated in FIGS. 2, 4, 5 and 6. A control knob 700 as illustrated in FIGS. 1, 3 and 7 having a rear cavity and a shaft collar extending from the rear cavity is mounted on said shaft and further having a knob stop plate pin 706 extending from the cavity and said stop plate pin positioned to engage the mechanical stop detent when the control knob rotates the shaft and rotary switch to its maximum setting. For one implementation of the device the maximum setting of the rotary switch is rotated about approximately 227, plus or minus 5, degrees from an off position.

One implementation of a current limiting device for an electric cooking range as disclosed and claimed herein includes a rotary switch as illustrated in FIGS. 8A and 8D having a shaft mounted to control the rotational position of the rotary switch and said shaft extends from said rotary switch. The device further includes a detent mounted on the rotary switch and position to engage and stop rotation of the shaft and the rotary switch at its maximum setting. For one implementation the maximum setting of the rotary switch is about approximately 227, plus or minus 5, degrees from an off position. One implementation includes a control knob having a rear cavity and a shaft collar extending from the rear cavity and mounted on said shaft.

One implementation current limiting device for an electric cooking range includes a limitless rotary switch 1000 having a shaft 1002 mounted to control the rotational position of the limitless rotary switch, where the rotation of the shaft varies the flow of current through a circuit to a load element as illustrated in FIG. 11, where the rotary switch cycles current flow through the circuit on and off at a frequency which depends upon the rotational position of the shaft as illustrated in FIG. 10C. For one implementation of the technology, a cam 1102 attached to the shaft 1002 where rotation of the shaft effects rotation of the cam where the cam is configured to vary the circuit operation to thereby vary the on and off cycle of the current flow such that the frequency of the on and off cycle doesn't allow the load element to exceed a specified temperature. For one implementation of the technology, the cam applies a varying pressure against a heated bi-metal where when the heated bi-metal gets enough current flowing heats up and the bi-metal becomes more flexible thereby bending under varying pressure of the rotating cam to thereby break a contact in the limitless switch thereby causing an on and off cycles of the switch based on the varying pressure of the cam. For one implementation, the cam configuration is designed to apply the desired varying pressure to cycle the switch off at the desired point in order to achieve an about approximately 50% on and 50% off result.

One implementation of a method to current limit an electric cooking range as disclosed and claimed herein includes, rotating a control knob having a rear cavity and a shaft collar extending from the rear cavity and mounted on a shaft extending from a rotary switch and where said control knob further having a knob stop plate pin extending from the cavity and said stop plate pin is positioned to engage a mechanical stop detent when the control knob rotates the shaft and the rotary switch to its maximum setting. For one implementation the method further includes rotating the shaft mounted to the rotary switch with the control knob thereby controlling the rotational position of the rotary switch; and controlling a current applied to a top burner element of an electric cooking range by rotating the control knob to thereby rotate the stop plate pin to engage a mechanical stop detent.

One implementation of a method to current limit an electric cooking range includes rotating a control knob having a rear cavity and a shaft collar extending from the rear cavity and mounted on a shaft extending from a rotary switch and rotating the shaft mounted to the rotary switch with the control knob thereby controlling the rotational position of the rotary switch. The method further includes controlling a current applied to a top burner element of an electric cooking range by rotating the control knob to thereby rotate the shaft to engage a mechanical stop detent of the rotary switch when the rotary switch is at its maximum setting.

One implementation of a method to current limit an electric cooking range include rotating a limitless rotary switch having a shaft mounted to control the rotational position of the limitless rotary switch, where the rotation of the shaft varies the flow of current through a circuit to a load element, where the rotary switch cycles current flow through the circuit on and off at a frequency which depends upon the rotational position of the shaft. The method further includes rotating a cam attached to the shaft where rotation of the shaft effects rotation of the cam where the cam is configured to vary the circuit operation to thereby vary the on and off cycle of the current flow such that the frequency of the on and off cycle doesn't allow the load element to exceed a specified temperature. For one implementation rotating the cam applies a varying pressure against a heated bi-metal where when the heated bi-metal gets enough current flowing heats up and the bi-metal becomes more flexible thereby bending under varying pressure of the rotating cam to thereby break a contact in the limitless switch thereby causing an on and off cycles of the switch based on the varying pressure of the cam.

Figure 13:
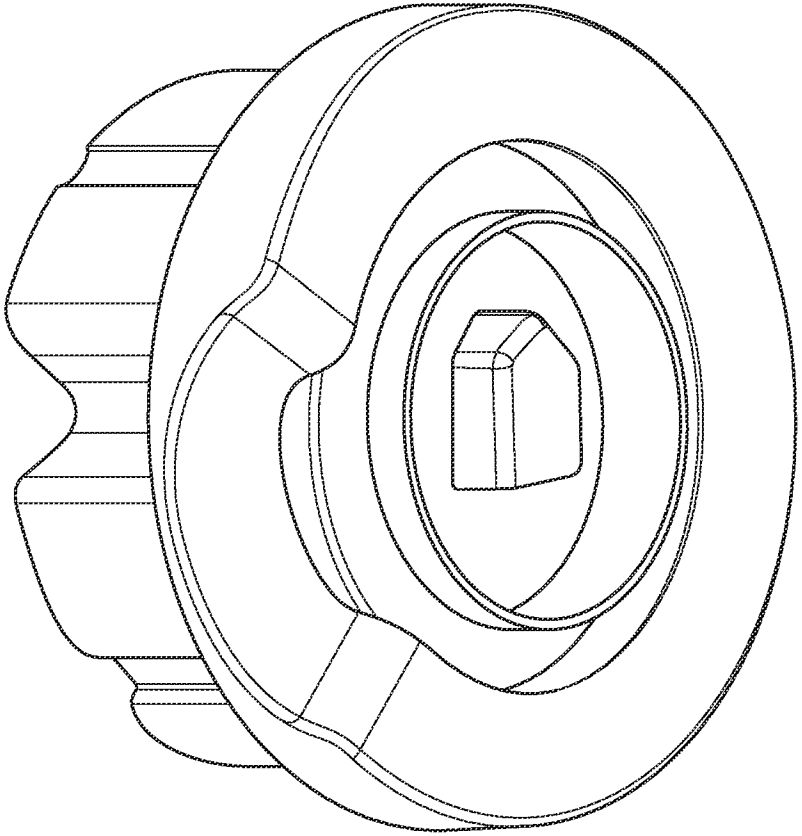
FIG. 13 is a perspective view of one implementation of the cam design.
Figure 14:
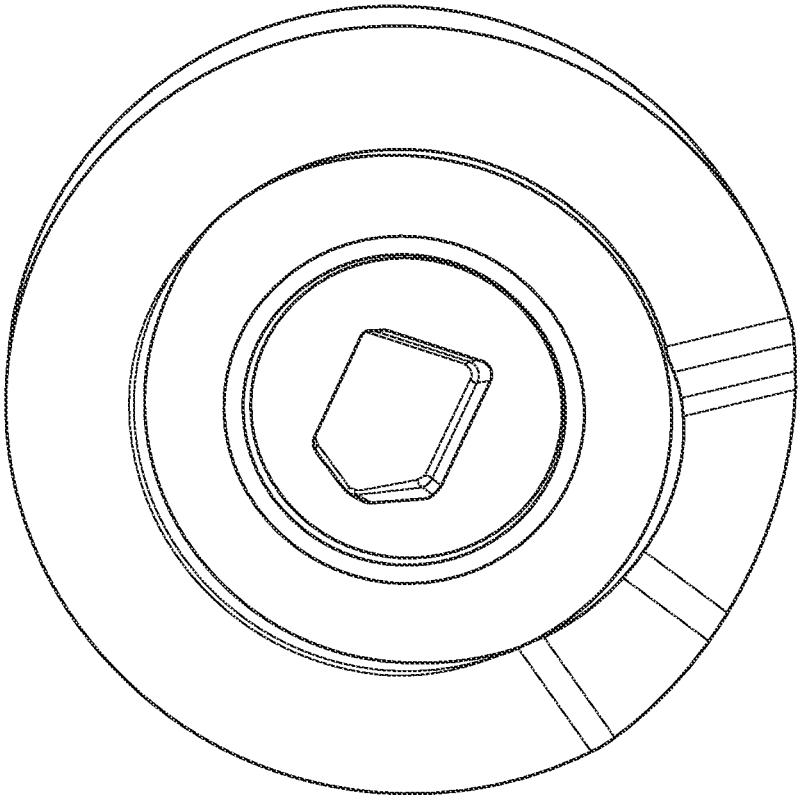
FIG. 14 is a front view of one implementation of the cam design.
Figure 15:
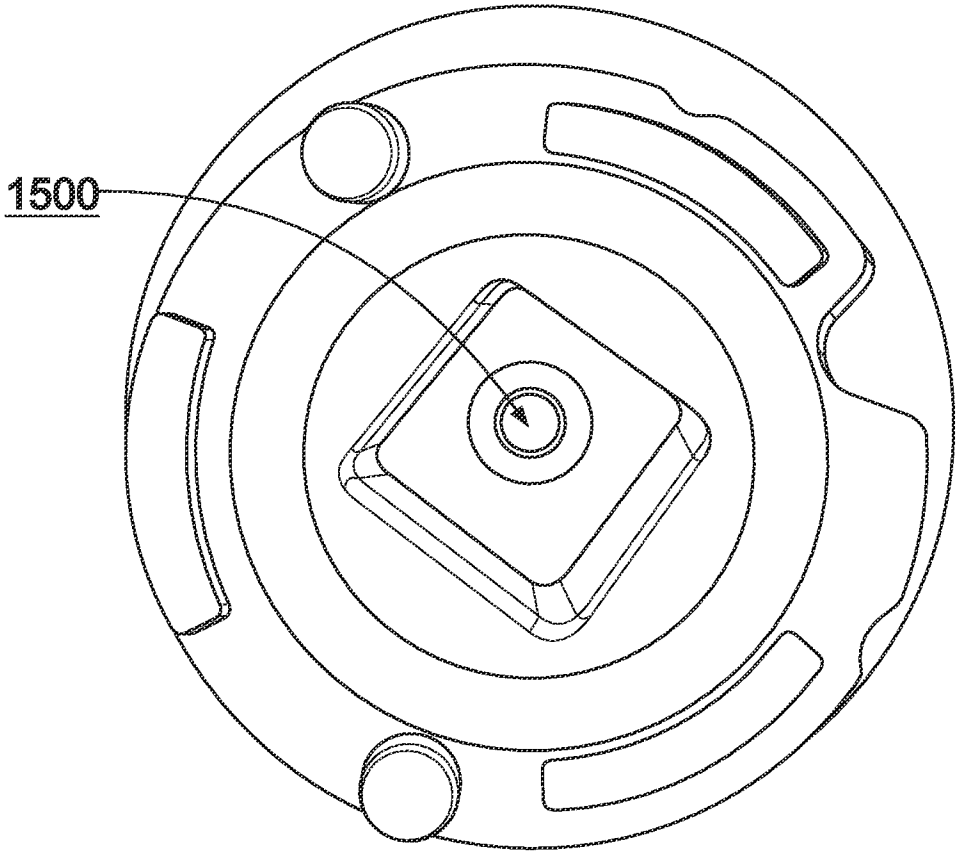
FIG. 15 is a rear view of one implementation of the design.

A detailed view of the cam configuration is provided in FIGS. 13, 14 and 15. As can be seen in FIG. 15, rotation of the cam about an axis of rotation identified by the arrow 1500 will cause the cam to apply a varying pressure against a heated bi-metal, because of the position of the axis of rotation, where when the heated bi-metal gets enough current flowing heats up and the bi-metal becomes more flexible thereby bending under varying pressure of the rotating cam to thereby break a contact in the limitless switch thereby causing an on and off cycles of the switch based on the increase pressure of the cam at given current flow, which causes the bi-metal to be more flexible.

The various current limiting examples shown above illustrate an apparatus and method for limiting the electrical current provided to a top burner element of an electric cooking range. A user of the present technology as disclosed may choose any of the above implementations, or an equivalent thereof, depending upon the desired application. In this regard, it is recognized that various forms of the subject current limiting device could be utilized without departing from the scope of the present invention.

As is evident from the foregoing description, certain aspects of the present technology as disclosed are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the scope of the present technology as disclosed and claimed.

Other aspects, objects and advantages of the present technology as disclosed can be obtained from a study of the drawings, the disclosure and the appended claims.

What is claimed is:

1. A current limiting device for an electric cooking range comprising:

a mechanical stop detent member extending from a mounting bracket where the mounting bracket has a central through hole;

a rotary switch having a shaft mounted to control the rotational position of the rotary switch and said shaft extends from said rotary switch and through the central through hole of the mounting bracket; and a control knob having a rear cavity and a shaft collar extending from the rear cavity and mounted on said shaft and further having a knob stop plate pin extending from the cavity and said stop plate pin positioned to engage the mechanical stop detent when the control knob rotates the shaft and rotary switch to its maximum setting.

2. The current limiting device as recited in claim 1, where the maximum setting of the rotary switch is rotated about approximately 227 degrees from an off position.

3. A current limiting device for an electric cooking range comprising:

a rotary switch having a shaft mounted to control the rotational position of the rotary switch and said shaft extends from said rotary switch;

a detent mounted on the rotary switch and position to engage and stop rotation of the shaft and the rotary switch at its maximum setting; and a control knob having a rear cavity and a shaft collar extending from the rear cavity and mounted on said shaft.

4. The current limiting device as recited in claim 3, where the maximum setting of the rotary switch is about approximately 227 degrees from an off position.

5. A method to current limit an electric cooking range comprising:

rotating a control knob having a rear cavity and a shaft collar extending from the rear cavity and mounted on a shaft extending from a rotary switch and where said control knob further having a knob stop plate pin extending from the cavity and said stop plate pin is positioned to engage a mechanical stop detent when the control knob rotates the shaft and the rotary switch to its maximum setting;

rotating the shaft mounted to the rotary switch with the control knob thereby controlling the rotational position of the rotary switch; and controlling a current applied to a top burner element of an electric cooking range by rotating the control knob to thereby rotate the stop plate pin to engage a mechanical stop detent.

6. A method to current limit an electric cooking range comprising:

rotating a control knob having a rear cavity and a shaft collar extending from the rear cavity and mounted on a shaft extending from a rotary switch;

rotating the shaft mounted to the rotary switch with the control knob thereby controlling the rotational position of the rotary switch; and controlling a current applied to a top burner element of an electric cooking range by rotating the control knob to thereby rotate the shaft to engage a mechanical stop detent of the rotary switch when the rotary switch is at its maximum setting.

* * * * *